United States Patent [19]

Dudzik

[11] Patent Number: 4,799,603

[45] Date of Patent: Jan. 24, 1989

[54] CONTAINER AND PLUG CLOSURE MEANS

[75] Inventor: Henryk Dudzik, Mansfield, United Kingdom

[73] Assignee: Mardon Illingworth Limited, Nottinghamshire, United Kingdom

[21] Appl. No.: 123,778

[22] Filed: Nov. 23, 1987

[30] Foreign Application Priority Data

Nov. 28, 1986 [GB] United Kingdom ..... 8628468

[51] Int. Cl.[4] ..... B65D 39/00

[52] U.S. Cl. ..... 220/307; 220/74; 150/55

[58] Field of Search ..... 220/74, 306, 307; 150/55

[56] References Cited

U.S. PATENT DOCUMENTS 4,228,916 10/1980 Weingardt .

4,452,382 6/1984 Von Holdt ..... 220/307

4,667,842 5/1987 Collins ..... 220/307

FOREIGN PATENT DOCUMENTS 459371 1/1937 United Kingdom .

2150540 7/1985 United Kingdom .

2168960 7/1986 United Kingdom .

*Primary Examiner*—George T. Hall

*Attorney, Agent, or Firm*—Bachman & LaPointe

[57] ABSTRACT

A container, for example a paint pot, is generally cylindrical, with an open end (2) into which a lid (6) plug-fits by engagement with a radially inwardly spaced skirt (45) which is connected to the wall (1) of the container by a flange (3). The flange forms an angle (A) within the wall (1) which is less than 90°, preferably 30°. Having an angled flange facilitates manufacture of the container by injection molding techniques.

11 Claims, 2 Drawing Sheets

CONTAINER AND PLUG CLOSURE MEANS

The present invention relates to a container, for example a container which is suitable for containing paint.

Until fairly recently, containers for paint have been made of sheet metal, formed into a generally cylindrical container. A lid having a peripheral axially-extending skirt plug-fits into the mouth of the container, the mouth being defined by a complimentary axially extending skirt which is located radially inwardly of the cylindrical wall of the container and joined thereto by an annular radial flange. An outwardly radially extending portion of the lid covers the skirt of the container and extends slightly beyond the skirt so that a tool can be inserted adjacent the flange of the container and used to lever off the lid.

Recently, such containers have been made increasingly of injection molded plastics material. One such container is described in GB-A No. 2 168 960.

It has been found, however, that the traditional form of metal paint container has not always lent itself to injection molding techniques. The present invention is intended to provide a modified form of container, having advantages associated with the traditional form, but being more readily produced by injection molding manufacturing processes.

Accordingly, one aspect of the present invention provides an injection-molded container having a base and side wall and an annular skirt within the side wall and defining the container mouth, the skirt being adapted to receive as a plug-fit a lid for the container, the skirt being connected to the side wall by a peripheral flange, the flange extending from the side wall to the skirt in a side wall as viewed in cross-section.

Preferably, the oblique angle is between 10° and 50°, more preferably between 20° and 40° and most preferably between 25° and 35°. In a particularly preferred embodiment the said angle is substantially 30°.

This construction leads to substantial advantages in terms of the ease of manufacturing the container, since it is possible to injection mold the container in one piece without use of collapsible molds and the complex control mechanisms required for such moulds.

Moulding in one piece avoids the necessity for additional welding steps to manufacture the container and also avoids the risks of failure inherent in welding techniques.

The axial extent of the flange is preferably between one and a half and three times the axial extent of the skirt.

Reference is now made to the accompanying drawings in which.

Figure 1:
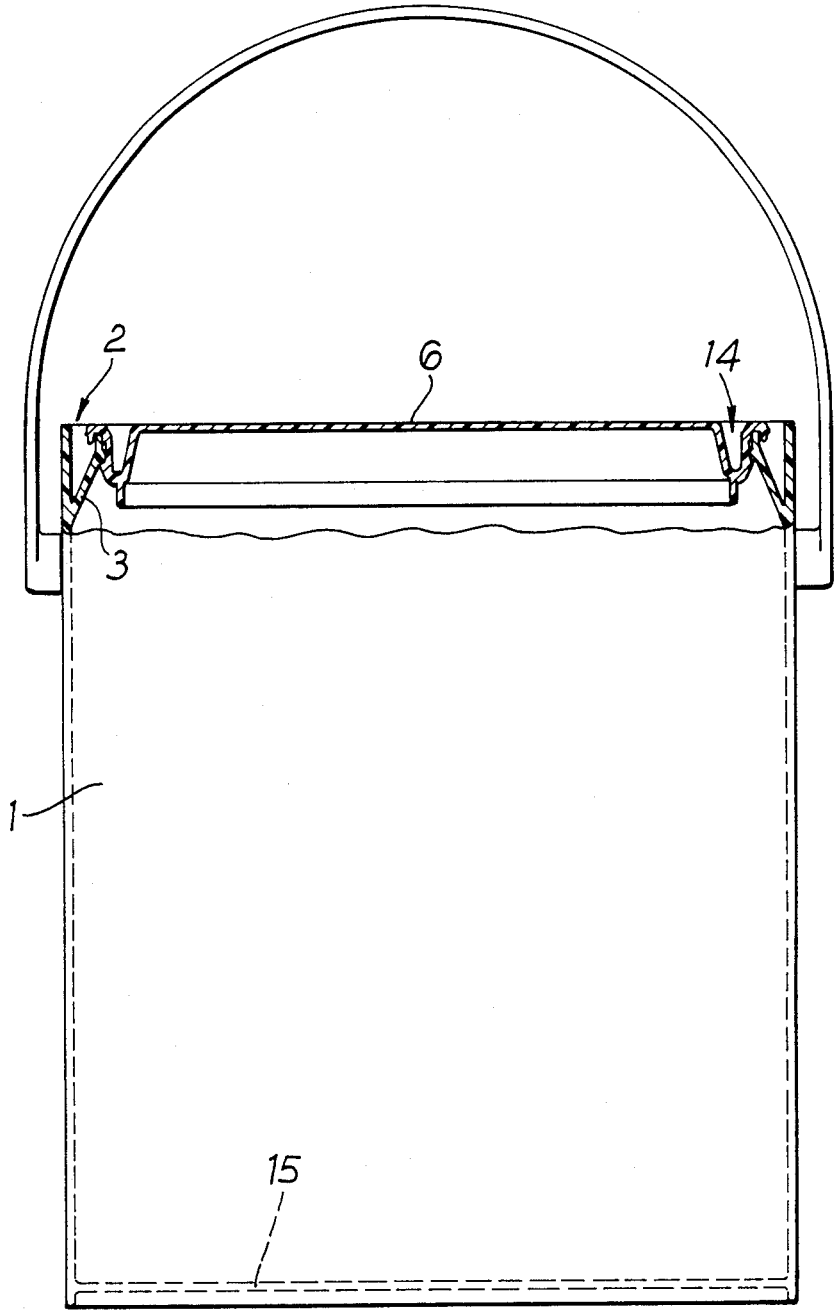
FIG. 1 is a side elevation of a container according to the invention.
Figure 2:
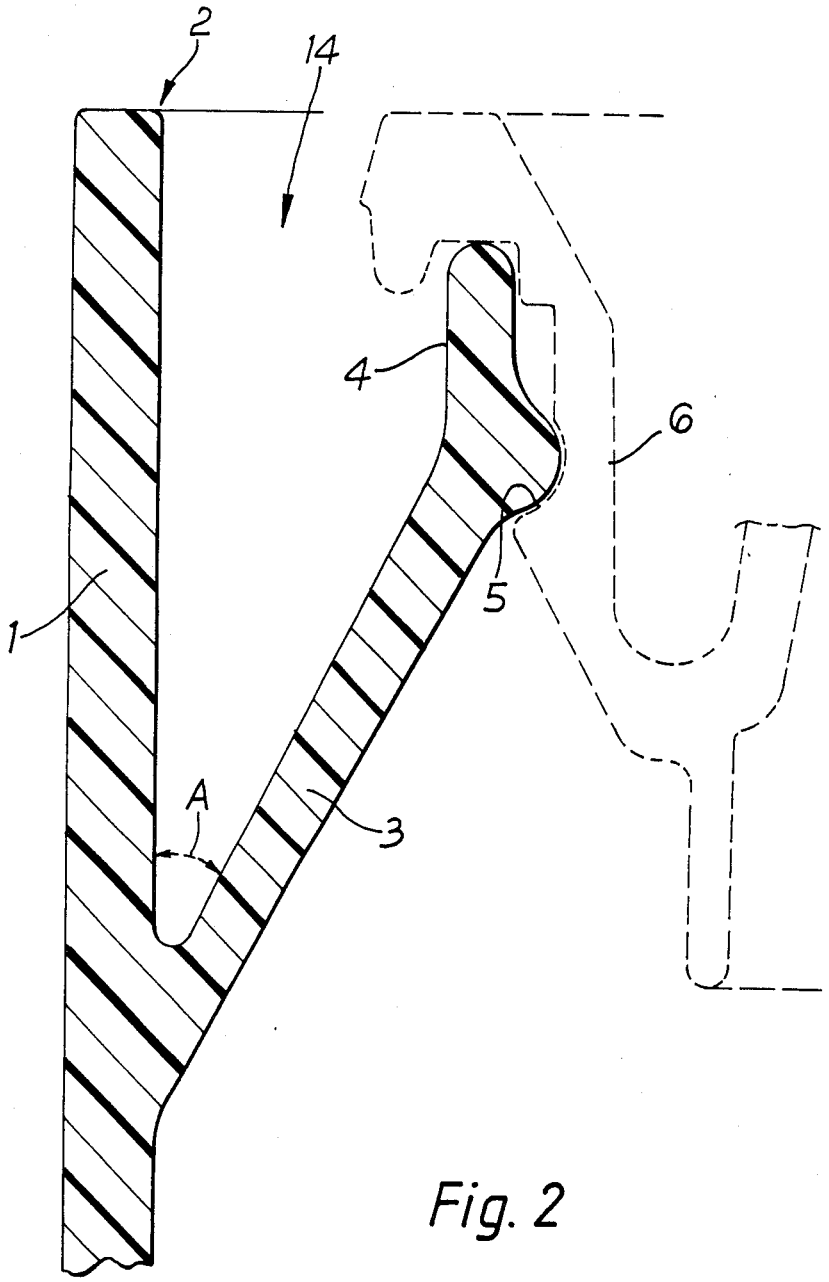
FIG. 2 is an enlarged sectional view of a portion of the container.

The side wall 1 of the container is generally cylindrical and is closed at one end by a base 15. Axially spaced from the opposite open end 2 of the container, a flange 3 extends from the wall 1 inwardly and towards the open end of the container, thus defining a truncated cone, and forming an oblique angle A with the wall 1 of the container as viewed in cross-section. In this embodiment, angle A is substantially 30°. The flange 3 extends to a position located axially inwardly of the open end 2 where the flange is integral with an axially-extending annular skirt 4 which extends from the flange 3 towards the diametral plane of the open end 2 of the container. Adjacent the position at which the flange 3 merges into the skirt 4, the skirt has a radially inwardly extending convex annular portion 5 which is adapted to engage a complementarily curved portion of the lid 6 for the container. The complementary curved portions of the skirt 4 and the lid 6 allow the lid to have a plug-fit engagement with the container in an advantageous manner, which is the subject of GB-A No. 2168960.

It will be seen, as is conventional in such containers, that a tool (not shown) may be inserted into the channel 14 formed between the flange 3 and the skirt 4, on the one hand, and the cylindrical wall 1 of the container, on the other hand, in order to lever the lid 6 away from the container.

The angle A is chosen as to optimize the ease of manufacture by injection molding of the container in one piece and the properties of the container when in use. Thus the container can be "bumped-off" the mold core, so that repeat molding can be at high speed. To facilitate such bumping-off, angle A should be as small as possible. However, too small an angle will mean that the flange 3 and associated skirt 4 are too resilient and may not form a satisfactory engagement with the lid 6. Conversely, greater rigidity of the flange 3 and the skirt 4 will be provided by having a large angle A, but this may not be compatible with the desired speed of manufacture. It has been found by the applicants that an angle A of about 30° represents the optimum.

It is to be noted that, although too much resilience associated with the flange 3 and the skirt 4 is undesirable, a degree of resilience provides for a better seal than if the flange 3 is at 90° to the wall 1, and hence this is a further advantage of containers in accordance with the invention. A third advantage which has been found is that it may be possible to dispense with the plurality of axial strengthening ribs which are commonly, in prior molded containers, located in the channel 14 between the wall 1 and the flange 3. This is because the flange 3 transmits forces exerted on the lids, e.g. when stacked, to the side wall without the flange being in shear and liable to deform as in conventional containers.

The container may be formed from any suitable plastics material, as is known in the art.

The container described is generally cylindrical. Although, in practice, it will usually be advantageous for the cylinder to have a circular axial cross-section, other cross-sections may be employed, for example a square cross-section to facilitate side-by-side storage of the containers.

I claim:

1. An injection molded container having a base, a side wall, an annular skirt within the side wall and defining the container mouth, the skirt being adapted to receive as a plug-fit a lid for the container, a lid received by the skirt in a plug-fit manner, a peripheral flange extending inwardly from the side wall and joined at one end to said side wall and its approximate end to said skirt, with the skirt being a continuation of the flange towards the mouth of the container, the flange extending from the side wall to the skirt in a direction towards the mouth at an oblique angle to the side wall as viewed in cross-section, said skirt having a radially extending convex, annular portion adapted to engage a complementary curved portion of the container lid.

2. A container according to claim 1 wherein the oblique angle is between 10° and 50°.

3. A container according to claim 1 wherein the oblique angle is between 20° and 40°.

4. A container according to claim 1 wherein the oblique angle is between 25° and 35°.

5. A container according to claim 1 wherein the oblique angle is substantially 30°.

6. A container according to claim 1 wherein the skirt extends axially from the flange towards the mouth of the container.

7. An injectin molded container having a base, a cylindrical side wall, an annular skirt within the side wall and defining the container mouth, the skirt being adapted for receiving as a plug-fit a lid for the container, a lid received by the skirt in a plug-fit manner, a peripheral flange of frusto-conical form extending inwardly from the side wall and joined at its larger diameter end to said side wall, the flange being joined at its smaller diameter end to said skirt with the skirt being a continuation of the flange towards the mouth of the container from said skirt to said side wall, said skirt having a radially inwardly extending convex annular portion adapted to engage a complementary portion of the container lid.

8. A container according to claim 1 wherein said flange forms a channel between the flange and skirt on the one hand and the side wall on the other providing a site for levering the lid away from the container.

9. A container according to claim 1 wherein the skirt has a radially inwardly extending convex annular portion.

10. A container according to claim 1 wherein the side wall is of generally constant cross section throughout its length.

11. A container according to claim 1 wherein the flange is operative to transmit forces exerted on the lid to the side wall without the flange being in shear.

* * * * *

UNITED STATES PATENT AND TRADEMARK OFFICE

CERTIFICATE OF CORRECTION

PATENT NO. : 4,799,603

DATED : January 24, 1989

INVENTOR(S) : HENRYK DUDZIK

It is certified that error appears in the above-identified patent and that said Letters Patent is hereby corrected as shown below:

In Column 1, line 35, after the words "in a" insert --direction towards the mouth at an oblique angle to the--.

In Column 3, claim 7, line 10, delete "Injectin" and insert --Injection-- and on line 19, after the word "container" insert --, said flange tapering outwardly in a direction inwardly of the container--.

Signed and Sealed this

Eighteenth Day of July, 1989

*Attest:*

DONALD J. QUIGG

*Attesting Officer*

*Commissioner of Patents and Trademarks*